US010971811B1

(12) United States Patent
Schwartz

(10) Patent No.: US 10,971,811 B1
(45) Date of Patent: Apr. 6, 2021

(54) 5G MEMBRANE RADIO SHROUD

(71) Applicant: Chad Schwartz, Annandale, NJ (US)

(72) Inventor: Chad Schwartz, Annandale, NJ (US)

(73) Assignee: CCS Technologies LLC, Annandale, NJ (US)

( * ) Notice: Subject to any disclaimer, the term of this patent is extended or adjusted under 35 U.S.C. 154(b) by 0 days.

(21) Appl. No.: 16/798,857

(22) Filed: Feb. 24, 2020

(51) Int. Cl.

| | |
|---|---|
| ***H01Q 1/42*** | (2006.01) |
| ***H01Q 1/24*** | (2006.01) |
| ***H01Q 1/00*** | (2006.01) |
| ***H01Q 1/12*** | (2006.01) |

(52) U.S. Cl.
CPC ..... *H01Q 1/427* (2013.01); *H01Q 1/002* (2013.01); *H01Q 1/1228* (2013.01); *H01Q 1/246* (2013.01)

(58) Field of Classification Search
CPC ..... H01Q 1/42; H01Q 1/427; H01Q 1/1228; H01Q 1/002; H01Q 1/246
See application file for complete search history.

(56) References Cited

U.S. PATENT DOCUMENTS

| | | | | |
|---|---|---|---|---|
| 5,742,653 | A | 4/1998 | Erbes et al. | |
| 9,357,886 | B2 | 6/2016 | Duncan et al. | |
| 9,698,477 | B1 | 7/2017 | Jabara et al. | |
| 10,135,130 | B1 * | 11/2018 | Bouchard | H01Q 1/245 |
| 10,347,979 | B1 * | 7/2019 | Boyle | H01Q 1/246 |
| 10,476,138 | B2 * | 11/2019 | Gonsowski | H01Q 1/1228 |
| 2015/0371571 | A1 * | 12/2015 | Hager | H04N 5/64 348/552 |
| 2018/0254545 | A1 * | 9/2018 | Hendrix | H01Q 1/1242 |

* cited by examiner

*Primary Examiner* — Hoang V Nguyen
(74) *Attorney, Agent, or Firm* — Thomas J. Germinario

(57) ABSTRACT

The present invention is a pole-mountable shroud assembly enclosing one or more wireless telecommunications transceivers and antennas. The shroud assembly is attached to the pole by a pole bracket, which is an elongated rectangular prism frame. The outer face of the pole bracket is open, so as to expose at least one intake fan supported by the pole bracket. The top and bottom ends of the pole bracket support top and bottom panels, respectively, with the bottom panel having multiple holes and/or vents, through which the intake fan(s) draw ambient air to cool the transceivers. A jacking means, such as a screw jack, connects the bottom panel to the pole bracket bottom end so that the panel separation distance is adjustable. A very thin (not more than one-tenth the minimum transmission wavelength) fabric membrane wraps around the top and bottom panels to the longitudinal sides of the pole bracket, so as to form a generally rectangular prism shaped shroud enclosure which surrounds the transceivers/antennas. The jacking means is operative to tension the fabric membrane around the shroud enclosure.

8 Claims, 3 Drawing Sheets

5G MEMBRANE RADIO SHROUD

FIELD OF INVENTION

The present invention relates to the general field of wireless telecommunications transceivers, and more particularly to shrouds for concealing such transceivers and their antennas.

BACKGROUND OF THE INVENTION 5G transceivers frequently have antennas which are integrated into the transceiver itself. It is usually desirable to conceal the transceivers/antennas from view for aesthetic reasons. But because 5G often uses millimeter wave technology, it is particularly susceptible to attenuation and dispersion by standard radio shrouds, which typically comprise ridged composite panels. Such panels can be one half to six or more wavelengths thick, causing 5G signal attenuation and dispersion. Therefore, there is a need for a very thin 5G shroud.

SUMMARY OF THE INVENTION

The present invention is a pole-mountable shroud assembly enclosing one or more wireless telecommunications transceivers and antennas. The shroud assembly is attached to the pole by a pole bracket, which is an elongated rectangular prism frame. The outer face of the pole bracket is open, so as to expose at least one intake fan supported by the pole bracket. The top and bottom ends of the pole bracket support top and bottom panels, respectively, with the bottom panel having multiple holes and/or vents, through which the intake fan(s) draw ambient air to cool the transceivers. A jacking means, such as a screw jack, connects the bottom panel to the pole bracket bottom end so that the panel separation distance is adjustable. A very thin (not more than one-tenth the minimum transmission wavelength) fabric membrane wraps around the top and bottom panels to the longitudinal sides of the pole bracket, so as to form a generally rectangular prism shaped shroud enclosure which surrounds the transceivers/antennas. The jacking means is operative to tension the fabric membrane around the shroud enclosure.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figures 1A, 1B:
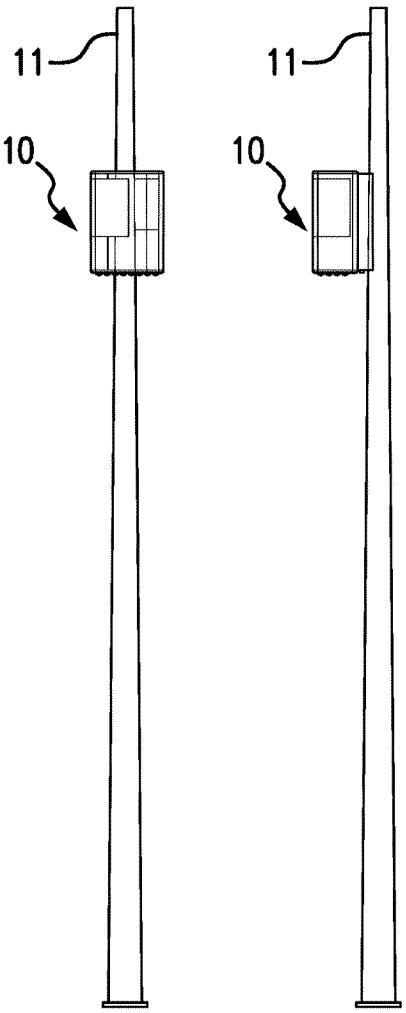
FIG. 1A is front view of an exemplary shroud assembly, according to one embodiment of the present invention, attached to a pole.
FIG. 1B is a side profile view of the shroud assembly depicted in FIG. 1A.
Figure 2B:
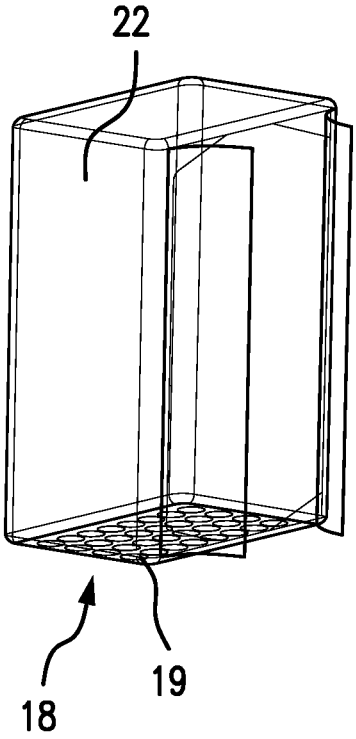
FIG. 2B is an isometric detail view of a portion of the shroud enclosure formed by the fabric membrane and the bottom panel.
Figure 2A:
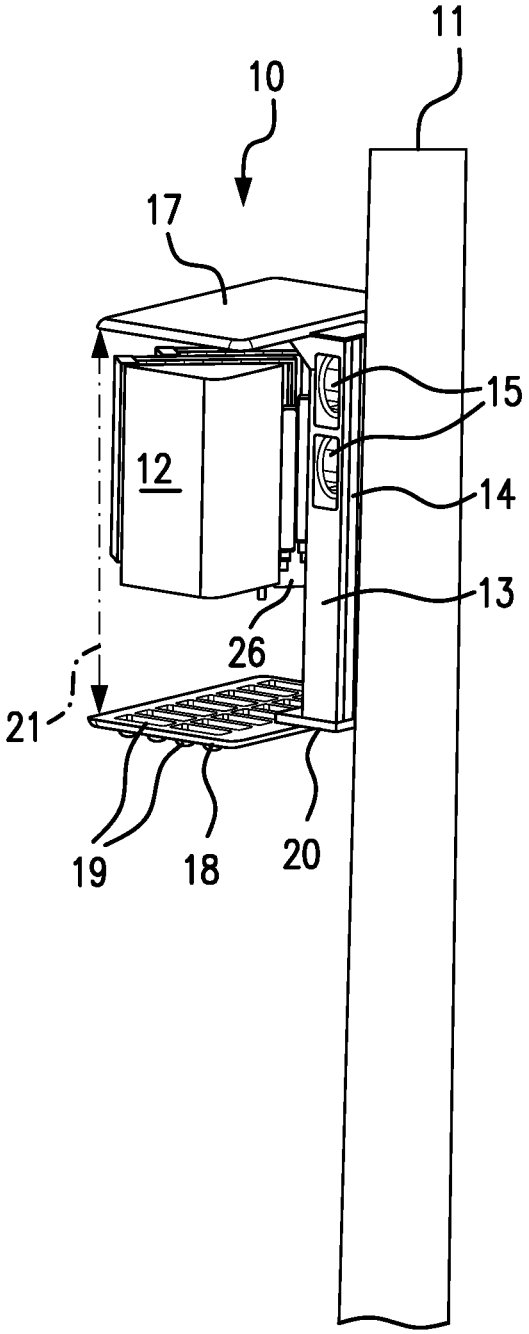
FIG. 2A is an isometric detail view of the shroud assembly depicted in FIGS. 1A and 1B, with the fabric membrane removed.

Referring to FIGS. 1A-1B, an exemplary shroud assembly 10 is attachable to a pole 11. As shown in FIGS. 2A, 3, 4A and 4B, the shroud assembly 10 encloses the 5G telecommunications transceiver/antenna 12, supported by a transceiver bracket 16. The shroud assembly 10 comprises a pole bracket 13, by which the shroud assembly 10 is connected to the pole 11 by a pole bracket attachment means 14, which can be multiple machine screws, nuts and bolts, rivets and/or metal straps. The pole bracket 13 at its top end supports, in the illustrated embodiment, two cooling fans 15, with their intake sides facing outward. Also supported by the pole bracket 13 are the top panel 17 and the bottom panel 18, which has multiple air intake apertures 19, through which ambient air is drawn by the cooling fans 15.

Figure 4A:
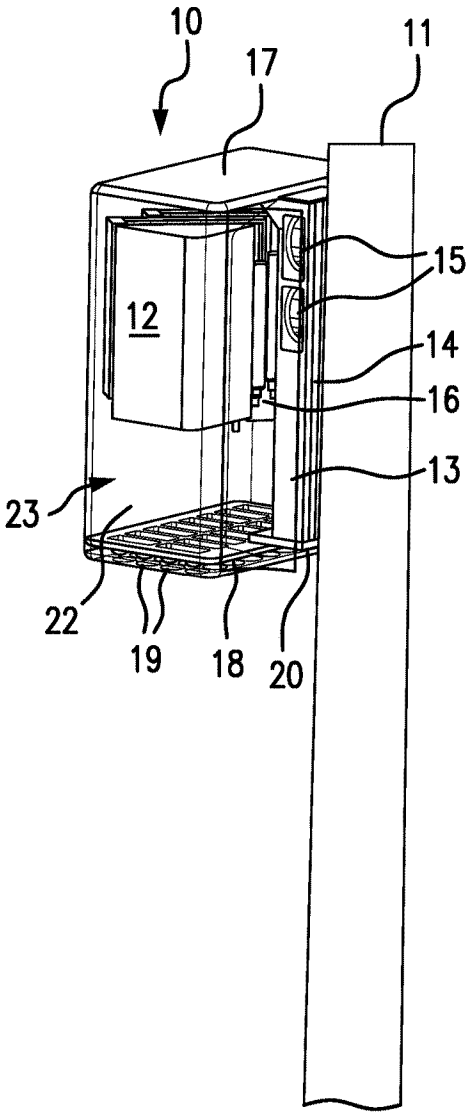
FIG. 4A is an isometric detail view of the shroud assembly with the shroud enclosure partly open.
Figure 4B:
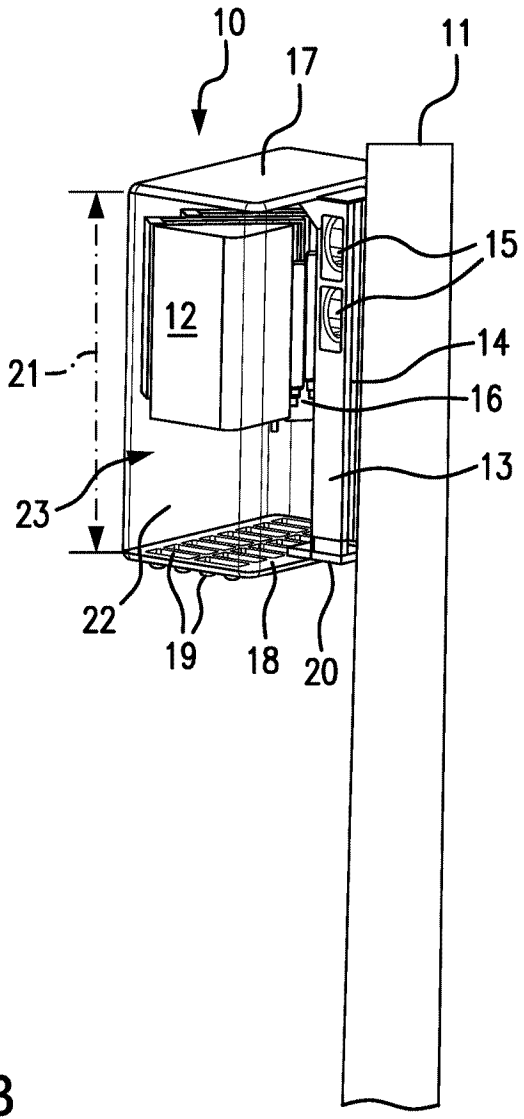
FIG. 4B is an isometric detail view of the shroud assembly with the shroud enclosure fully closed.
Figure 3:
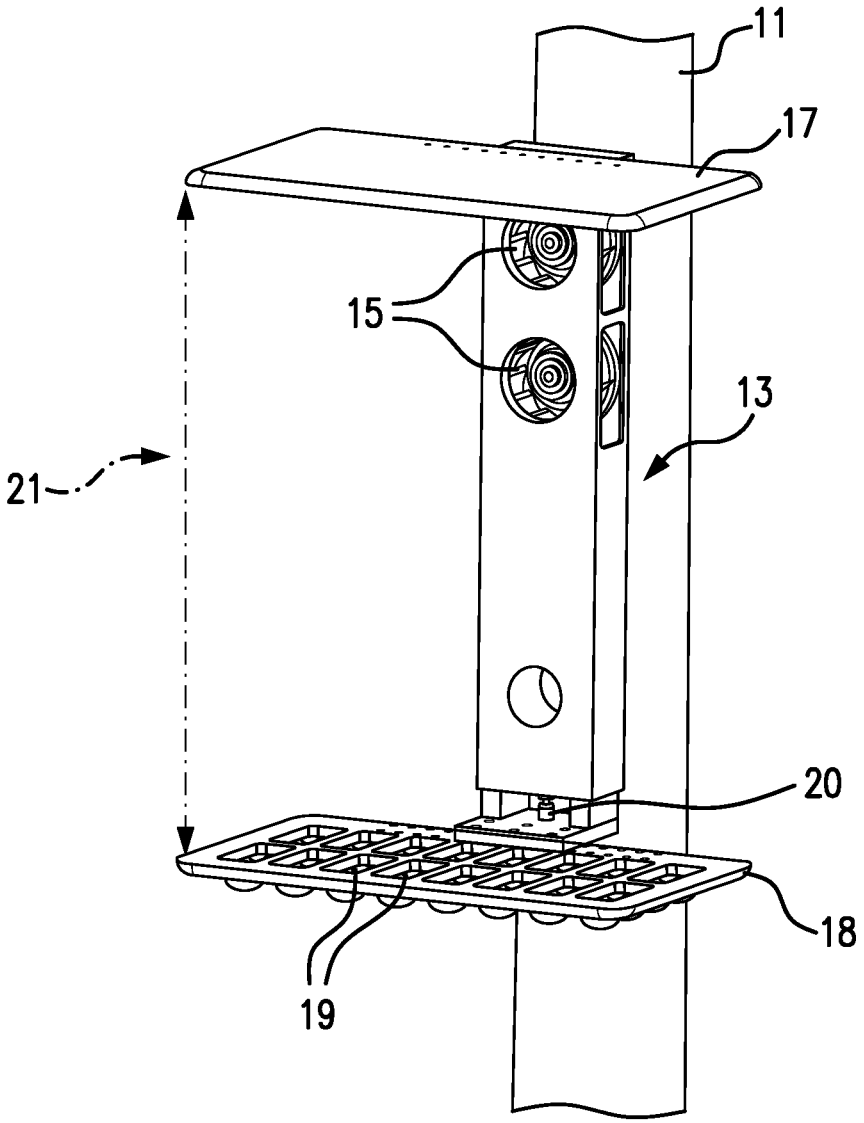
FIG. 3 is a front perspective view of the pole bracket supporting the top panel and adjustably attached to bottom panel by a screw jack.

As best seen in FIG. 3, the bottom panel 18 is attached to the bottom end of the pole bracket 13 by a jacking means 20, which can be a screw jack or an over-center jack. The jacking means 20 is used to adjust the panel separation distance 21. As best seen in FIGS. 4A-4B, the fabric membrane 22 partially wraps around the top panel 17 and bottom panel 18 to connect with the longitudinal sides of the pole bracket 13 to form a roughly rectangular prism shaped shroud enclosure 23 surrounding the transceiver/antenna 12. The jacking means 20 tightens and tensions the fabric membrane 22 around the shroud enclosure 23. Preferably, the fabric membrane 22 has a thickness one-tenth to one-twentieth of the minimum transmission wavelength of the transceiver/antenna 12.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A shroud assembly, which is adapted to be mounted on a pole having a pole diameter, and which encloses one or more wireless telecommunications transceivers and antennas, having a minimum transmission wavelength, the shroud assembly comprising:

a pole bracket, which is rigidly attachable to the pole by one or more pole bracket attachment means, wherein the pole bracket forms an elongated, generally rectangular prism, having a pole bracket top end and a pole bracket bottom end, and having a pole bracket width approximating the pole diameter, and having two longitudinal pole bracket-sides, and wherein the pole bracket has a closed inner bracket face, which is configured to engage the pole, and an open outer bracket face;

one or more cooling fans, wherein each of said cooling fans has an intake side and an exhaust side, and wherein the cooling fans are mounted within the pole bracket with the intake side exposed to the open outer bracket face;

one or more transceiver brackets, which support the telecommunications transceivers and antennas, and which are rigidly attached to and extend from the pole bracket so that the telecommunications transceivers and antennas face the cooling fans;

a solid, generally rectangular top panel, which is rigidly attached to the pole bracket top end and which has a top panel perimeter;

a generally rectangular bottom panel, having a bottom panel perimeter which is substantially congruent with the top panel perimeter, wherein the bottom panel has multiple air intake apertures, through which the cooling fans draw ambient air into the shroud assembly in order to dissipate heat generated by the transceivers;

a jacking means, by which the bottom panel is adjustably attached to the pole bracket bottom end, wherein the jacking means is operative to adjust a vertical panel separation distance between the bottom panel and the top panel; and a generally rectangular fabric membrane, having a fabric thickness of less than or equal to one-tenth of the minimum transmission wavelength, wherein the fabric membrane has a horizontal first membrane dimension and a vertical second membrane dimension, and wherein the first membrane dimension matches the top panel perimeter less the pole bracket width; and wherein the second membrane dimension matches the panel separation distance, and wherein the fabric membrane wraps partially around the top panel perimeter and the bottom panel perimeter to engage the pole bracket sides, so as to form a shroud enclosure surrounding the wireless telecommunications transceivers and antennas, and wherein, by increasing the panel separation distance, the jacking means is operative to tighten and tension the fabric membrane around the shroud enclosure.

2. The shroud assembly according to claim 1, wherein the pole bracket attachment means is selected from the group consisting of machine screws, rivets, bolts with nuts, and metal straps.

3. The shroud assembly according to claim 2, wherein the jacking means comprises a screw jack or an over-center jack.

4. The shroud assembly according to claim 3, wherein the fabric thickness is in the range of one-tenth to one-twentieth of the minimum transmission wavelength.

5. The shroud assembly according to claim 2, wherein the fabric thickness is in the range of one-tenth to one-twentieth of the minimum transmission wavelength.

6. The shroud assembly according to claim 1, wherein the jacking means comprises a screw jack or an over-center jack.

7. The shroud assembly according to claim 6, wherein the fabric thickness is in the range of one-tenth to one-twentieth of the minimum transmission wavelength.

8. The shroud assembly according to claim 1, wherein the fabric thickness is in the range of one-tenth to one-twentieth of the minimum transmission wavelength.

* * * * *